US006106092A

United States Patent [19]

Norigoe et al.

[11] Patent Number: 6,106,092

[45] Date of Patent: Aug. 22, 2000

[54] DRIVING METHOD OF AN INK-JET HEAD

[75] Inventors: Takashi Norigoe, Shizuoka-ken, Japan; Michael George Arnott, Somersham, United Kingdom

[73] Assignees: Kabushiki Kaisha TEC, Shizuoka, Japan; Xaar Technology Limited, Canbridge, United Kingdom

[21] Appl. No.: 09/215,003

[22] Filed: Dec. 17, 1998

[30] Foreign Application Priority Data

Jul. 2, 1998 [GB] United Kingdom ..... 9814247

[51] Int. Cl.[7] ..... B41J 29/38; B41J 2/045

[52] U.S. Cl. ..... 347/11; 347/68

[58] Field of Search ..... 347/10, 11, 68

[56] References Cited

U.S. PATENT DOCUMENTS

| | | | |
|---|---|---|---|
| 3,846,800 | 11/1974 | Chen . | |
| 3,893,131 | 7/1975 | Perel et al. . | |
| 3,979,756 | 9/1976 | Helinski et al. . | |
| 4,161,670 | 7/1979 | Kern . | |
| 4,222,060 | 9/1980 | Sato et al. . | |
| 4,353,079 | 10/1982 | Kawanabe . | |
| 4,468,679 | 8/1984 | Suga et al. . | |
| 4,471,363 | 9/1984 | Hanaoka . | |
| 4,503,444 | 3/1985 | Tacklind . | |
| 4,513,299 | 4/1985 | Lee et al. | 346/140 |
| 4,523,201 | 6/1985 | Liker . | |
| 4,536,097 | 8/1985 | Nilsson . | |
| 4,639,735 | 1/1987 | Yamamoto et al. . | |
| 4,646,106 | 2/1987 | Howkins . | |
| 4,686,539 | 8/1987 | Schmidle et al. . | |
| 4,697,193 | 9/1987 | Howkins . | |
| 4,897,665 | 1/1990 | Aoki . | |
| 5,124,716 | 6/1992 | Roy et al. . | |
| 5,221,931 | 6/1993 | Moriyama . | |
| 5,252,986 | 10/1993 | Takaoka et al. . | |
| 5,359,350 | 10/1994 | Nakano et al. . | |
| 5,426,455 | 6/1995 | Williamson et al. . | |
| 5,436,648 | 7/1995 | Stortz et al. . | |
| 5,444,467 | 8/1995 | Stortz . | |
| 5,461,403 | 10/1995 | Wallace et al. . | |
| 5,594,476 | 1/1997 | Tokunaga et al. . | |
| 5,600,349 | 2/1997 | Keefe . | |
| 5,610,637 | 3/1997 | Sekiya et al. . | |
| 5,625,397 | 4/1997 | Allred et al. . | |
| 5,657,060 | 8/1997 | Sekiya et al. . | |
| 5,689,291 | 11/1997 | Tence et al. . | |
| 5,717,448 | 2/1998 | Inada . | |
| 5,729,257 | 3/1998 | Sekiya et al. . | |
| 5,736,993 | 4/1998 | Regimbal et al. . | |
| 5,764,256 | 6/1998 | Zhang | 347/10 |
| 5,903,286 | 5/1999 | Takahashi | 347/11 |

FOREIGN PATENT DOCUMENTS

| | | |
|---|---|---|
| 0064881 A2 | 11/1982 | European Pat. Off. . |
| 0124190 A2 | 11/1984 | European Pat. Off. . |
| 0194852 A2 | 9/1986 | European Pat. Off. . |

(List continued on next page.)

*Primary Examiner*—John Barlow
*Assistant Examiner*—An H. Do
*Attorney, Agent, or Firm*—Frishauf, Holtz, Goodman, Langer & Chick, P.C.

[57] ABSTRACT

In a multi-drop system, a drive pulse voltage for increasing a volume of an ink chamber is applied for a time of AL, a drive pulse voltage for decreasing the volume of the ink chamber is subsequently applied for a time of 2AL, application of the drive pulse voltage is thereafter paused for a time of AL, and the same timing operation is thereafter repeated again to perform emission of an ink drop a plurality of times, where AL is a time required for a pressure wave in an ink chamber to be transmitted from an end to the other end in the ink emission direction. The drive pulse voltage for emitting a last ink drop forming a part of a one-dot liquid drop is applied for a time of 2AL, application of the drive pulse voltage is thereafter paused for a time of AL, and a dumping pulse voltage is thereafter applied in a direction in which the volume of the ink chamber is decreased.

19 Claims, 4 Drawing Sheets

FOREIGN PATENT DOCUMENTS

| | | |
|---|---|---|
| 0259541 A2 | 3/1988 | European Pat. Off. . |
| 0271905 A2 | 6/1988 | European Pat. Off. . |
| 0437106 A2 | 7/1991 | European Pat. Off. . |
| 0575204 A2 | 12/1993 | European Pat. Off. . |
| 0609997 A2 | 8/1994 | European Pat. Off. . |
| 0652106 A2 | 5/1995 | European Pat. Off. . |
| 0728584 A2 | 8/1996 | European Pat. Off. . |
| 0737586 A1 | 10/1996 | European Pat. Off. . |
| 0778132 A2 | 6/1997 | European Pat. Off. . |
| 0787588 A2 | 8/1997 | European Pat. Off. . |
| 0812689 A1 | 12/1997 | European Pat. Off. . |
| 0816081 A2 | 1/1998 | European Pat. Off. . |
| 0835757 A2 | 4/1998 | European Pat. Off. . |
| 57-160654 | 10/1982 | Japan . |
| 59-176060 | 10/1984 | Japan . |
| 59-207265 | 11/1984 | Japan . |
| 61-22959 | 1/1986 | Japan . |
| 2-34343 | 2/1990 | Japan . |
| 4-369542 | 12/1992 | Japan . |
| 6-155733 | 6/1994 | Japan . |
| 6-344552 | 12/1994 | Japan . |
| 7-156388 | 6/1995 | Japan . |
| 7-164629 | 6/1995 | Japan . |
| 9-66603 | 3/1997 | Japan . |
| 9-104110 | 4/1997 | Japan . |
| 10-24570 | 1/1998 | Japan . |
| 10-157099 | 6/1998 | Japan . |
| 2157623 | 10/1985 | United Kingdom . |
| WO 94/26520 | 11/1994 | WIPO . |
| WO 94/26522 | 11/1994 | WIPO . |
| WO 94/26524 | 11/1994 | WIPO . |
| WO 94/26525 | 11/1994 | WIPO . |
| WO 95/34427 | 12/1995 | WIPO . |
| WO 98/08687 | 3/1998 | WIPO . |

DRIVING METHOD OF AN INK-JET HEAD

BACKGROUND OF THE INVENTION

The present invention relates to a method of driving a drop-on demand type ink-jet head of a multi-drop system which merges a plurality of ink-drops sequentially emitted from an orifice of an ink chamber to form a single liquid drop.

There has been a method of expressing gradations by using an ink-jet head which performs printing in such a manner in which a plurality of ink chambers are provided, drive pulse voltages are applied to piezoelectric members provided in correspondence with the ink chambers so as to cause the piezoelectric members to be transformed, and the ink chambers are selectively deformed by the transitions of the piezoelectric members so as to emit ink from the ink chambers. A method known as the kind of method described above is, for example, a method of expressing gradations in which sizes of ink drops hit on a recording medium are changed by controlling volumes of ink drops to be emitted by P.W.M. (Pulse-Width-Modulation) control, as disclosed in U.S. Pat. No. 5,461,403, or a method of expressing gradations in which a plurality of ink drops are emitted sequentially from one same orifice and the number of ink drops hit on one same portion on a recording medium is controlled.

The former method has a problem that the emission volumes of ink drops are not constant unless the following ink drop is emitted under a condition that meniscus of the orifice is recovered and stabilized to some extent after emission of a previous ink drop from the orifice. Therefore, the driving frequency must be lowered, so that the printing speed is difficult to be increased. In contrast, the latter method of a multi-drop system is advantageous in that it is possible to improve the printing speed by increasing the driving frequency and that small liquid drops can be emitted without reducing the emission speed. However, since a line head performs printing while moving a recording medium in the sub-scanning direction, for example, there is a problem that the recording medium itself is moved and the printed dots are elongated in the moving direction of the recording medium while sequentially emitting seven liquid drops in case of performing one-dot printing by emission of seven liquid drops within a drop-on-demand drop production period.

A method of solving the above problems is, for example, that the speed of ink drops to be emitted later is gradually increased to be higher than the speed of the ink drop to be emitted first, such that the ink drops emitted later catch up with and are merged with the ink drops emitted earlier to obtain one liquid drop therefrom when the ink drops hit on a recording medium, as disclosed in U.S. Pat. No. 5,285,215. This is realized by applying successive drive pulse voltages to a piezoelectric member such that the amplitude of a pressure wave in an ink chamber is gradually increased when emitting ink.

However, in this case, the vibration amplitude of an ink chamber increases and the vibration of the liquid surface (or meniscus) at an orifice is increased accordingly since the emission speed of ink drops to be emitted later is increased. Meanwhile, printing cannot be started until the vibration of the meniscus of the orifice ceases, where printing for a next line is started after printing for one line is completed. If the vibration of the meniscus of the orifice is large, the time required until the vibration ceases is elongated. As a result, there is a problem that the printing speed cannot sufficiently be increased.

BRIEF SUMMARY OF THE INVENTION

Hence, the present invention has an object of providing a driving method of an ink-jet head capable of decreasing early the pressure vibration of an ink chamber and of improving the printing speed to be sufficiently high, in which ink drops are sequentially emitted from an ink chamber a plurality of times with use of an ink-jet head which selectively deforms a plurality of ink chambers by a transition of a piezoelectric member to cause an ink chamber to emit ink, while gradually increasing the emission speed of the ink drops such that ink drops emitted later are merged with ink drops emitted earlier to form a single liquid drop.

The invention provides a method for driving an ink-jet head having a plurality of ink chambers each partitioned by side walls made of piezoelectric members, in which the side walls of the ink chambers are selectively applied with a drive pulse voltage to cause pressure disturbances in the ink chambers by transitions of the piezoelectric members and the ink chambers are selectively deformed to eject ink drops, the method comprising the steps of:

generating a series of drive pulse voltages applied to an ink chamber;

increasing a volume of an ink chamber to decrease a pressure of the ink chamber by an application of a first drive pulse voltage of the series of drive pulse voltages;

subsequently decreasing the volume of the ink chamber to increase the pressure of the ink chamber by an application of a second drive pulse voltage of the series of the drive pulse voltages;

recovering thereafter an original volume of the ink chamber to eject an ink drop; and repeating the increasing, decreasing and recovering steps a plurality of times to eject a plurality of successive ink drops, while gradually increasing a velocity of the successive ink drops such that one of the successive ink drops ejected later is merged with a preceding ink drop ejected earlier thereby forming a single ink drops, wherein the second drive pulse voltage for ejecting a last ink drop of the successive ink drops is applied for a first period of time, application of the drive pulse voltage is thereafter paused for a second period of time and a dumping pulse voltage is thereafter applied to cause the pressure disturbances of the ink chamber to be decreased.

According to the present invention, it is possible to decrease the pressure vibration of an ink chamber in an early stage and to improve the printing speed to be sufficiently high, in a driving method of an ink-jet head, in which ink drops are sequentially emitted from an ink chamber a plurality of times with use of an ink-jet head which selectively deforms a plurality of ink chambers by a transition of a piezoelectric member to cause an ink chamber to emit ink, while gradually increasing the emission speed of the ink drops such that ink drops emitted later are synthesized with ink drops emitted earlier to form a one-dot liquid drop.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be explained with reference to the drawings.

Figure 1:
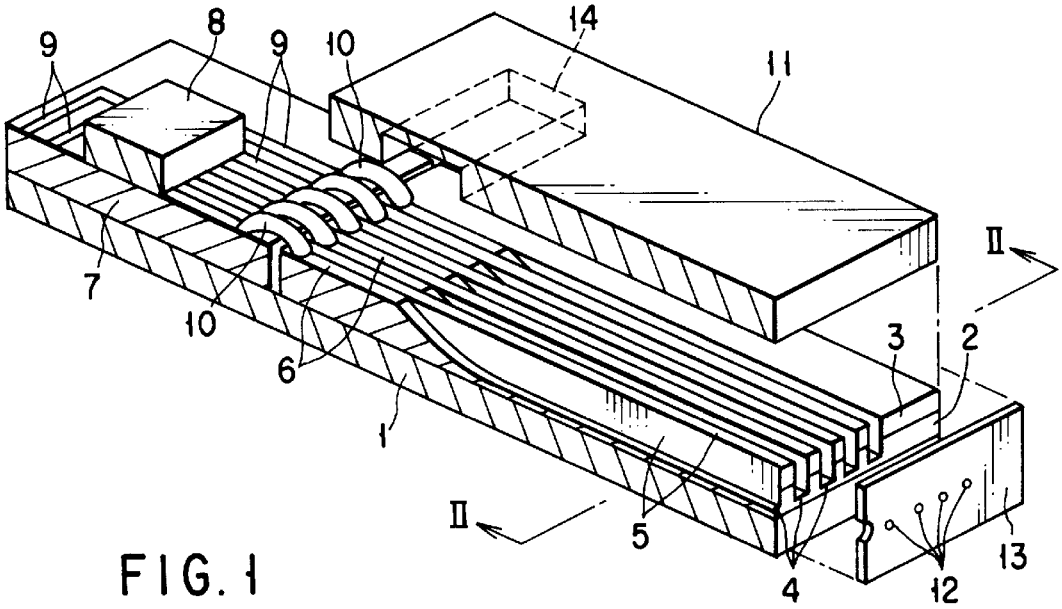
FIG. 1 is an exploded perspective view showing an embodiment of the present invention from which a part of an ink-jet head is cut away.

FIG. 1 is an exploded perspective view showing an ink-jet head partially cut away, and two sheets of rectangular piezoelectric members 2 and 3 are adhered and fixed to one side of the surface of a substrate 1 made of a ceramics, by an epoxy resin adhesion. A plurality of long grooves 4 which are disposed in parallel at a predetermined interval and have an equal width, an equal depth, and an equal length are formed in the piezoelectric members 2 and 3 by a diamond cutter. Electrodes 5 are formed on the side surfaces and the bottom surfaces of the long grooves 4, and lead electrodes 6 are formed from rear ends of the long grooves 4 to the rear upper surface of the piezoelectric member 3. These electrodes 5 and 6 are formed by electroless nickel plating.

A printed circuit boad 7 is adhered and fixed to the other side of the surface of the substrate 1. A drive IC 8 including a drive circuit is mounted on the printed circuit boad, and conductive patterns 9 connected to the drive IC 8 are formed also on the printed circuit boad. Further, the conductive patterns 9 are respectively connected to the lead electrodes 6 through wires 10 by wire bonding.

A top plate 11 made of a ceramics is adhered and fixed to the piezoelectric member 3 by an epoxy resin adhesion. In addition, a nozzle plate 13 provided with a plurality of orifices 12 is adhered and fixed to the top end of each of the piezoelectric members 2 and 3 by an adhesion. In this manner, the upper portions of the long grooves 4 are covered by the top plate 11, and the top ends thereof are closed by the nozzle plate 13, such that each of the grooves forms an ink chamber which acts as a pressure chamber. A common ink chamber 14 is formed in the top plate 11, and rear ends portions of the ink chambers formed by the long grooves 4 communicate with the common ink chamber 14. Further, the common ink chamber 14 communicates with an ink supply cartridge (not shown).

Figure 2:
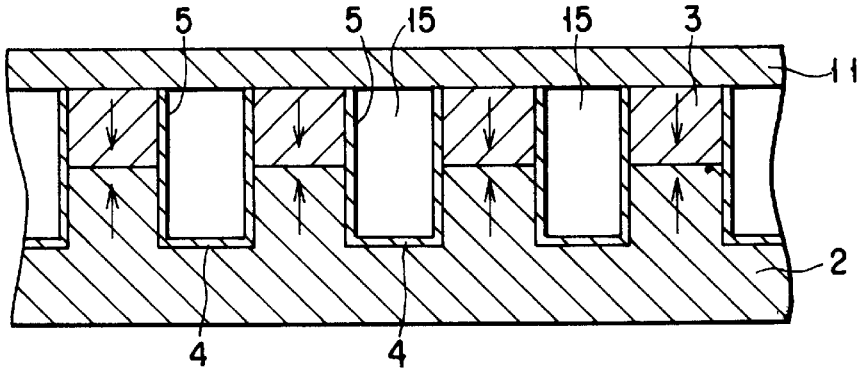
FIG. 2 is a a partial cross-sectional view showing the ink-jet head in FIG. 1 cut along a line II—II without the substrate.

FIG. 2 is a partial cross-sectional view showing the ink-jet head having the structure shown in FIG. 1, cut along a line II—II without the substrate 1. Side walls of the ink chambers 15 formed by the long grooves 4 are made of the piezoelectric members 2 and 3 which are respectively polarized in directions opposed to each other along the plate-thickness, as indicated by arrows in the figure.

Figure 3A:
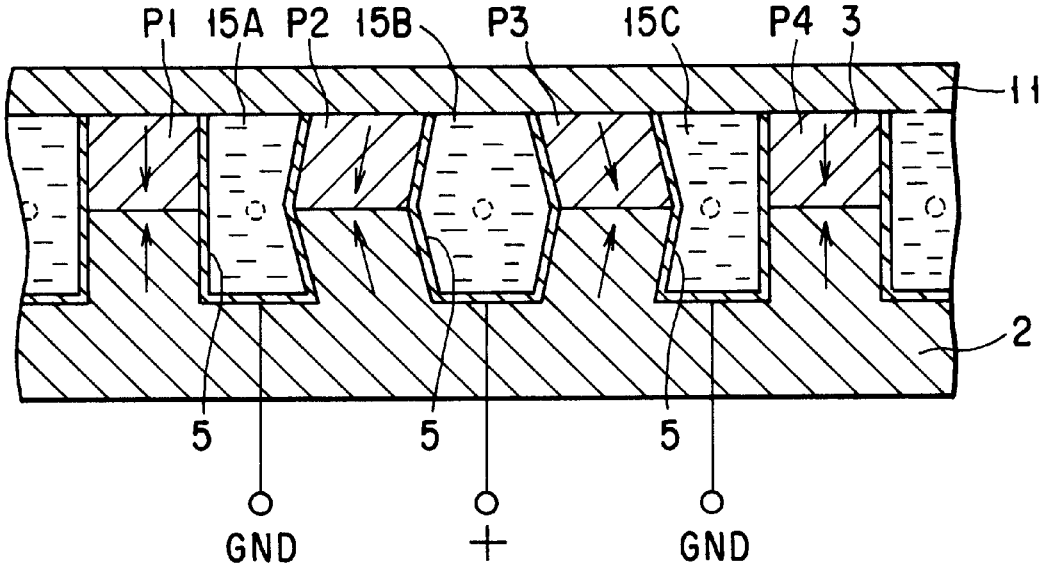
FIGS. 3A and 3B are views for explaining ink emission operation in the ink-jet head according to the embodiment.

Next, operational principles of the ink-jet head will be explained below with reference to FIGS. 3A and 3B.

On condition that each ink chamber 15 is filled with ink, attention is paid to three ink chambers 15A, 15B, and 15C partitioned by side walls P1, P2, P3, and P4 made of piezoelectric members 2 and 3. Supposing that the electrode 5 of the center ink chamber 15B is applied with a positive voltage and the electrodes 5 of both the adjacent ink chambers 15A and 15C are set to a ground potential (GND), both the side walls P2 and P3 of the ink chamber 15B are respectively polarized in directions opposed to each other in the film-thickness direction, and therefore, the side walls P2 and P3 are rapidly deformed outwards so as to enhance the volume of the ink chamber 15B. By this deformation, ink is supplied to the ink chamber 15B from the common ink chamber 14.

Figure 3B:
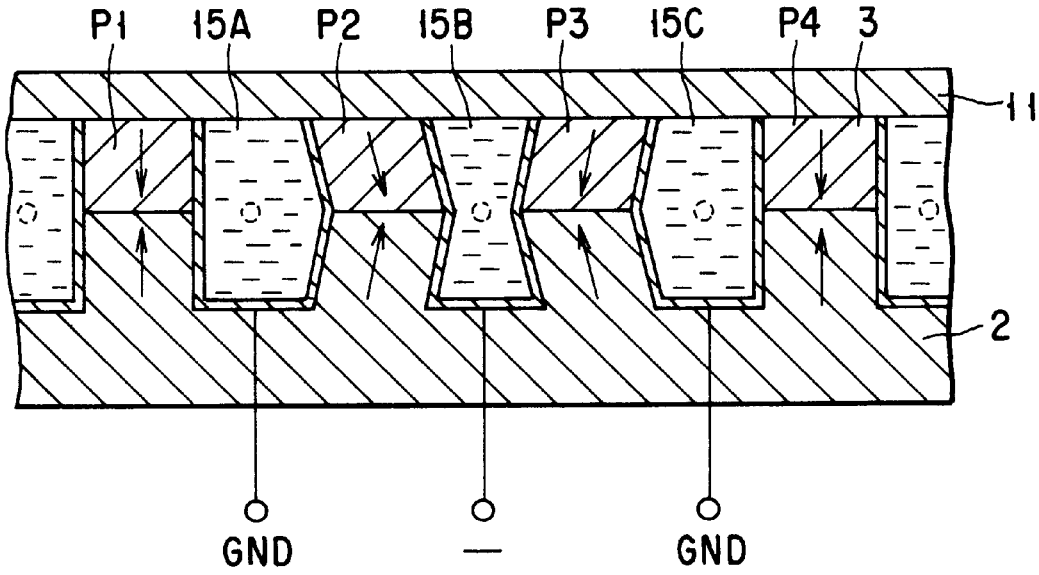

In this state, the electrode 5 of the center ink chamber 15B is next applied with a negative voltage while the electrodes 5 of both the adjacent ink chambers 15A and 15C maintained at the ground potential, as shown in FIG. 3B, both the side walls P2 and P3 of the ink chamber 15B are rapidly deformed inwards so as to reduce the volume of the ink chamber 15B. In this state, the potential of the electrode 5 of the ink chamber 15B is further changed to the ground potential, and then, the side walls P2 and P3 rapidly recovers an original condition. By this recovery operation, the tail of an ink drop pushed out of the orifice 12 is cut and the ink drop flies toward a print medium.

A driving method of the ink-jet head will now be explained below.

Figure 4:
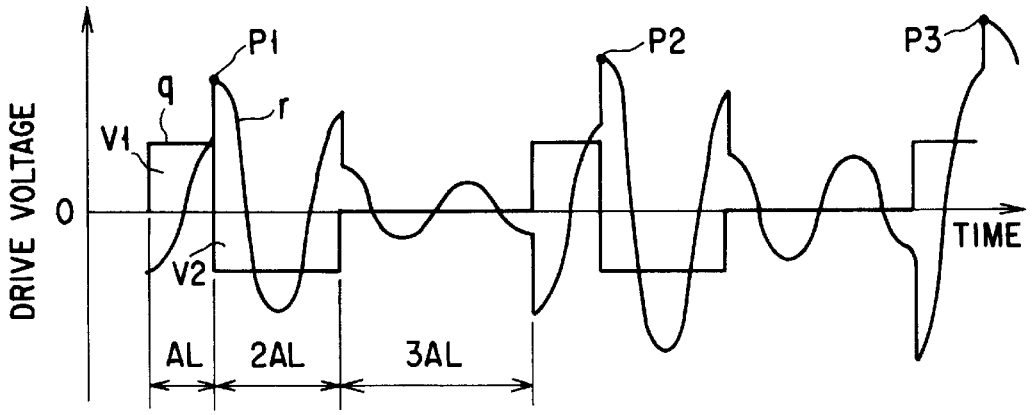
FIG. 4 is a graph showing a relationship between a drive pulse waveform and a pressure vibration waveform in an ink chamber where the ink-jet head according to the embodiment is driven by a multi-drop system.

FIG. 4 shows a drive pulse waveform q and a pressure vibration waveform r generated in the ink chamber 15. In the figure, AL denotes an application time which corresponds to a time period required for a pressure wave generated in the ink chamber 15 to be transmitted from an end to the other end of the ink chamber 15.

Firstly, a voltage V1 as a positive voltage is applied to the electrode 5 of the ink chamber 17 from which ink should be emitted, and then, the ink chamber 15 is deformed so as to enhance its volume, so that a negative pressure is generated in the ink chamber 15. Next, a negative voltage V2 is applied after the positive voltage V1 is thus applied for a period of AL. Since the phase of the pressure wave then corresponds to that of the negative voltage V2 thus applied, and thereafter, the amplitude of the pressure wave is rapidly increased to generate a pressure wave of P1. At this time, a first drop of ink is pushed out of the orifice 12.

After this negative voltage V2 is applied for a period of 2AL, the voltage is returned to the original ground level. The phase of the pressure wave is then inverted, so that the amplitude of the pressure wave is weakened and pauses maintaining this condition for a period of 3AL. Note that the pause period is not limited to 3AL but may be a period as odd-numbered times long as AL.

Next, a voltage V1 as a positive voltage is applied to the electrode 5 of the ink chamber 15 to emit a second drop of ink, like the above-described case of the first drop. After a period of 3AL, the pressure wave in the ink chamber 15 becomes a negative pressure, and therefore, the phase of the pressure wave corresponds thereto and is thereby amplified. Thereafter, a voltage pulse similar to that for the first drop is applied, and therefore, the pressure vibration changes in a similar manner although the vibration amplitude of the pressure wave is increased to be P2 which is greater than that of the first drop.

Accordingly, in case of printing eight gradations, for example, seven drops of ink are sequentially emitted from the orifice 12 while gradually increasing the vibration of the pressure wave from P1 to P2, P3, . . . . The later the order of the emission of ink drops, the faster the emission speed thereof is. Therefore, drops of ink emitted later catch up with drops of ink emitted earlier, and the drops of ink are merged into one ink drop which reaches a recording medium. Thus, one dot is formed on the recording medium.

The above-described emission of successive seven drops of ink is carried out within a drop-on-demand drop production period. One dot on a recording medium is formed by one drop in this period.

In this kind of driving method, when drops of ink are sequentially emitted, the pressure vibration in the ink chamber 15 is increased thereby erroneously causing adjacent ink chambers to emit ink. Accordingly, the vibration of meniscus of the orifice is increased. The pressure vibration and meniscus vibration influence an adjacent ink chamber having a common side wall. Therefore, such an adjacent ink chamber cannot perform stable ink emission operation before the meniscus vibration ceases and recovers a predetermined liquid surface level. However, even if ink emission from an adjacent ink chamber is carried out after the meniscus vibration ceases, it is not possible to sufficiently improve the printing speed.

Figure 5:
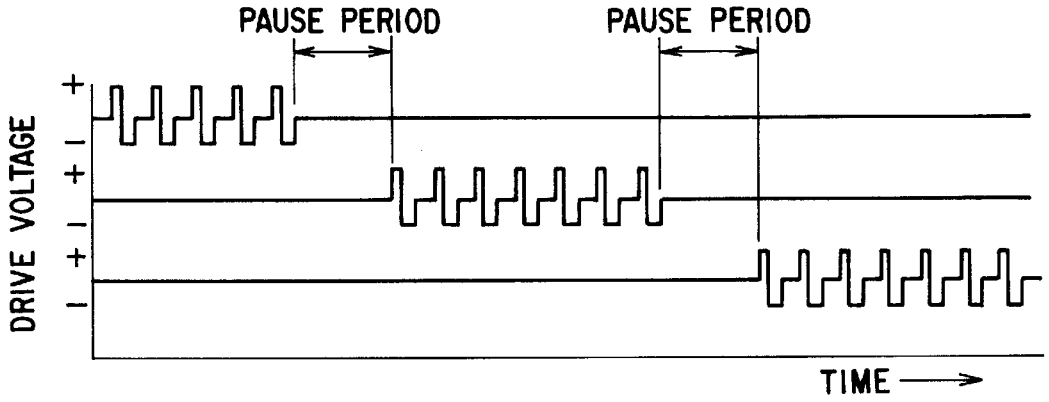
FIG. 5 is a graph showing parts of drive pulse waveforms where three grouped ink chambers of the ink-jet head according to the embodiment are driven in a time-divided manner in a multi-drop system.

For example, supposing a case of driving the ink-jet head including three grouped ink chambers in a time-divided manner, a drive pulse waveform for emitting the largest liquid drop corresponding to an eighth gradation will be as shown in FIG. 5. In the time-divided driving, after emission control of ink drops from an orifice 12 of an ink chamber 15 of a first group of ink chambers is carried out, a predetermined pause period is elapsed, and then, emission of an ink drop from an adjacent ink chamber of a second group those of is carried out. At this time, the pause period represents a time required until the pressure vibration of the ink chamber of the first group decreases and the meniscus vibration of the orifice thereof decreases to a predetermined value or less after the ink emission from the ink chamber of the first group is completed. Therefore, the pause period is relatively long and it is difficult to sufficiently improve the printing speed.

Figure 6:
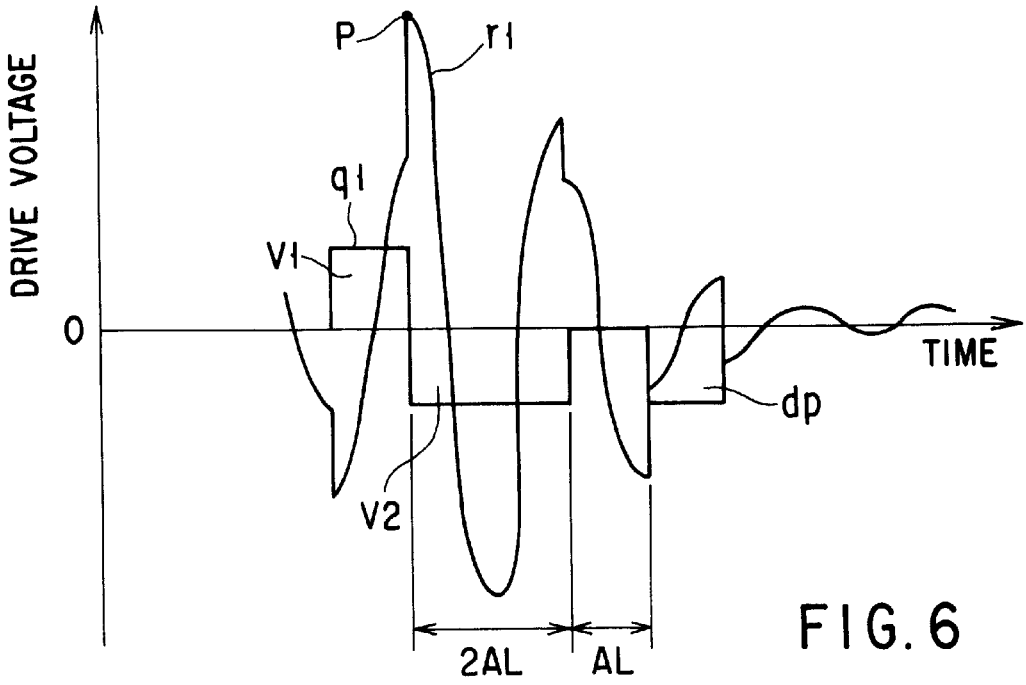
FIG. 6 is a graph showing a relationship between, a drive pulse waveform for causing a last ink drop to be emitted, a pressure vibration waveform in an ink chamber, and a dumping voltage waveform, where the ink-jet head according to the embodiment is driven by a multi-drop system.

Hence, a sufficient improvement of the printing speed is attained by adopting a driving method shown in FIG. 6. In the figure, a drive pulse q1 is supplied for emitting the last ink drop forming a part of one dot. In the first place, a positive voltage V1 is applied to the electrode of an ink chamber 15 by the drive pulse q1 for a period AL, and subsequently, a pressure wave having an amplitude P is obtained by applying a negative voltage V2. Further, a negative voltage V2 is applied for a period 2AL to cause the ink drop to be emitted from the ink emission port 12, and thereafter, the voltage is returned to the original ground level, so that the phase of the pressure wave is inverted and the amplitude of the pressure wave is weakened. Further, a pause for a time AL is taken, and thereafter, a voltage in a direction in which the volume of the ink chamber 15 is decreased is applied as a dumping voltage dp, i.e., a negative voltage is applied as a dumping voltage dp.

By application of this dumping voltage dp, a positive pressure wave is generated when the pressure vibration in the ink chamber 15 is negative. In this manner, the pressure wave vibration in the ink chamber 15 is decreased in an early stage. As a result, the meniscus vibration ceases early, and ink emission operation from an ink chamber adjacent to the ink chamber by which an immediately preceding emission operation is carried out can be started immediately. The printing speed can thus be improved to be sufficiently high.

In the embodiment described above, explanation has been made of a case in which the application time of the negative voltage V2 of the drive pulse for emitting the last ink drop is set to 2AL. However, the application time of this voltage is not limited hitherto, but may be changed as far as the application time is a time period defined by multiplying 2AL by an integer. Also, a pause period for a time AL is taken after the negative voltage V2 is applied for a time 2AL. However, the pause period is not limited hitherto, but may be changed as far as the pause period is a time period defined by multiplying AL by an odd number where a negative voltage is applied as a dumping voltage dp.

Figure 7:
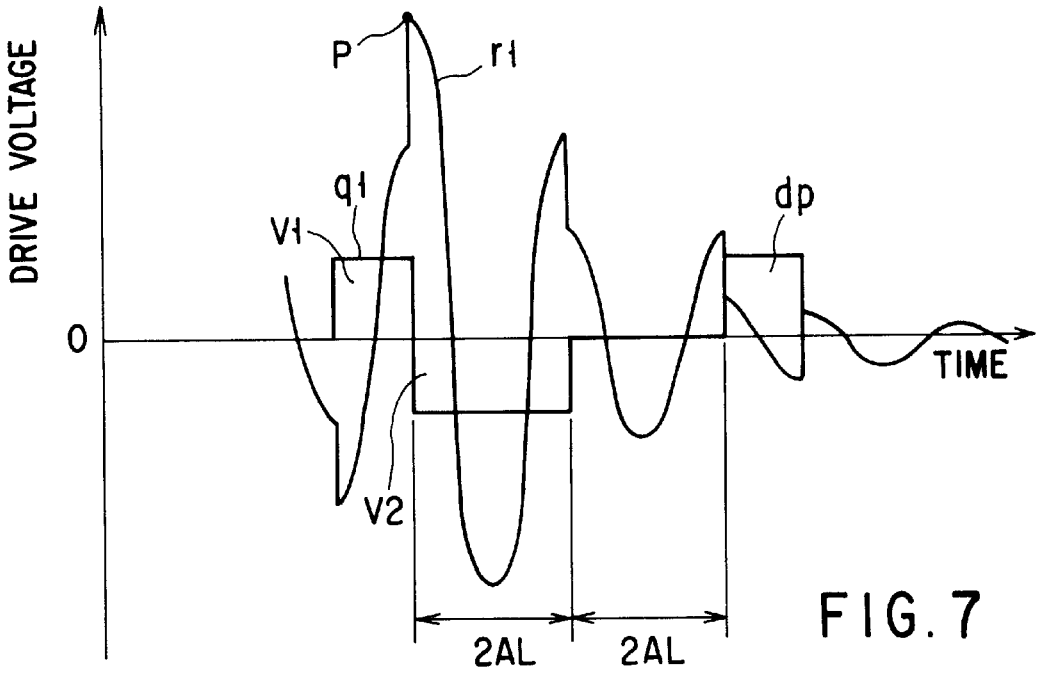
FIG. 7 is a graph showing a relationship between, a drive pulse waveform for causing a last ink drop to be emitted, a pressure vibration waveform in an ink chamber, and a dumping voltage waveform, where an ink-jet head according to another embodiment is driven by a multi-drop system.

In the embodiment described above, the voltage applied to the ink chamber is returned to the ground level after the negative voltage V2 is applied for a time 2AL. In this state, a pause for a time AL is taken, and thereafter, the negative dumping voltage dp is applied. However, the present invention is not limited hitherto. The voltage applied is returned to the ground level after application of the negative voltage V2 for a time 2AL shown in FIG. 7, and in this state, a pause for a time 2AL is taken. Thereafter, a voltage in a direction in which the volume of the ink chamber 15 is increased may be applied as the dumping voltage dp.

In this case, a negative pressure wave is generated by application of the dumping voltage dp when the pressure vibration in the ink chamber 15 is positive, and as a result, the pressure wave vibration in the ink chamber 15 is decreased early. In this manner, the meniscus vibration ceases in an early stage, and ink emission operation from an adjacent ink chamber can be started immediately. Thus, the printing speed can be improved to be sufficiently high.

Also, in this case, the application time of the negative voltage V2 of the drive pulse for emitting the last ink drop may be a time period defined by multiplying 2AL by an integer. In addition, the pause period taken after application of the negative voltage V2 for 2AL is not always limited to 2AL, but may be changed as long as a pause period defined by multiplying AL by an even number is taken.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A method for driving an ink-jet head having a plurality of ink chambers each partitioned by side walls made of piezoelectric members, in which the side walls of the ink chambers are selectively applied with voltages to cause pressure disturbances in the ink chambers by transitions of the piezoelectric members so that the ink chambers are selectively deformed to eject ink drops, the method comprising, with respect to a respective one of each of the plurality of ink chambers, the steps of:

generating a series of drive pulse voltages to be applied to the ink chamber;

increasing a volume of the ink chamber to decrease a pressure of the ink chamber by an application of a first drive pulse voltage of the series of drive pulse voltages;

subsequently decreasing the volume of the ink chamber to increase the pressure of the ink chamber by an application of a second drive pulse voltage of the series of the drive pulse voltages;

recovering thereafter an original volume of the ink chamber to eject an ink drop; and repeating the increasing, decreasing and recovering steps a plurality of times to eject a plurality of successive ink drops, while gradually increasing a velocity of the successive ink drops such that one of the successive ink drops ejected later is merged with a preceding ink drop ejected earlier to thereby form a single ink drop, wherein the second drive pulse voltage for ejecting a last ink drop of the successive ink drops is applied for a first period of time, a ground level pulse voltage is then applied for a second period of time, and a dumping pulse voltage is thereafter applied to cause the pressure disturbances of the ink chamber to be decreased.

2. A method according to claim 1, wherein AL is a time required when a pressure wave in the ink chamber is transmitted from a first end to a second end of the ink chamber in an ink ejection direction, and the first period of time is defined by multiplying 2AL by an integer and the second period of time is defined by multiplying AL by an odd number.

3. A method according to claim 2, wherein the dumping pulse voltage is applied to cause the volume of the ink chamber to be decreased.

4. A method according to claim 2, wherein the first drive pulse voltage in the increasing step during performance of the repeating step is applied for a time of AL and the second drive pulse voltage in the decreasing step during the performance of the repeating step is applied for a time of 2AL.

5. A method according to claim 2, wherein the generating step includes a sub step of generating a third drive pulse voltage having a ground value between a previous second drive pulse voltage and a succeeding first drive pulse voltage during performance of the repeating step.

6. A method according to claim 1, wherein AL is a time required when a pressure wave in the ink chamber is transmitted from a first end to a second end of the ink chamber in an ink ejection direction, and the first period of time is defined by multiplying 2AL by an integer and the second period of time is defined by multiplying AL by an even number.

7. A method according to claim 6, wherein the dumping pulse voltage is applied to cause the volume of the ink chamber to be increased.

8. A method according to claims 6, wherein the first drive pulse voltage in the increasing step during performance of the repeating step is applied for a time of AL and the second drive pulse voltage in the decreasing step during the performance of the repeating step is applied for a time of 2AL.

9. A method according to claim 6, wherein the generating step includes a sub step of generating a third drive pulse voltage having a ground value between a previous second drive pulse voltage and a succeeding first drive pulse voltage during performance of the repeating step.

10. A method according to claim 1, wherein AL is a time required when a pressure wave in the ink chamber is transmitted from a first end to a second end of the ink chamber in an ink ejection direction, and the first drive pulse voltage in the increasing step during performance of the repeating step is applied for a time of AL and the second drive pulse voltage in the decreasing step during the performance of the repeating step is applied for a time of 2AL.

11. A method according to claim 10, wherein the generating step includes a sub step of generating a third drive pulse voltage having a ground value between a previous second drive pulse voltage and a succeeding first drive pulse voltage during performance of the repeating step.

12. A method according to claim 10, wherein the repeating step is performed within a drop-on-demand drop production period.

13. A method according to claim 11, wherein the recovery step is performed by application of the third drive pulse voltage for a time defined by multiplying AL by an odd number during the performance of the repeating step.

14. A method according to claim 11, wherein the repeating step is performed within a drop-on-demand drop production period.

15. A method according to claim 1, wherein the generating step includes a sub step of generating a third drive pulse voltage having a ground value between a previous second drive pulse voltage and a succeeding first drive pulse voltage during performance of the repeating step.

16. A method according to claim 15, wherein AL is a time required when a pressure wave in the ink chamber is transmitted from a first end to a second end of the ink chamber in an ink ejection direction, and the recovery step is performed by application of the third drive pulse voltage for a time defined by multiplying AL by an odd number during the performance of the repeating step.

17. A method according to claim 15, wherein the repeating step is performed within a drop-on-demand drop production period.

18. A method according to claim 16, wherein the repeating step is performed within a drop-on-demand drop production period.

19. A method according to claim 1, wherein the repeating step is performed within a drop-on-demand drop production period.

* * * * *